US007398936B1

(12) United States Patent
Wang

(10) Patent No.: US 7,398,936 B1
(45) Date of Patent: Jul. 15, 2008

(54) TOP AND SIDE LOADING SHREDDER WITH OPTIONAL HANDLE

(75) Inventor: Tie Chun Wang, Taipei (TW)

(73) Assignee: Michilin Prosperity Co., Ltd., Taipei (TW)

( * ) Notice: Subject to any disclaimer, the term of this patent is extended or adjusted under 35 U.S.C. 154(b) by 0 days.

(21) Appl. No.: 11/650,274

(22) Filed: Jan. 5, 2007

(51) Int. Cl.
*B02C 19/00* (2006.01)

(52) U.S. Cl. ..... 241/100; 241/285.1

(58) Field of Classification Search ..... 241/100, 241/236, 295, 285.1; 220/756, 752, 212.5
See application file for complete search history.

(56) References Cited

U.S. PATENT DOCUMENTS

| | | | | |
|---|---|---|---|---|
| 4,023,702 | A * | 5/1977 | McKnight | 220/756 |
| 4,550,828 | A * | 11/1985 | Baldwin et al. | 206/349 |
| 4,650,127 | A | 3/1987 | Radwanski | |
| 4,815,670 | A | 3/1989 | Iwai | |
| 4,821,967 | A | 4/1989 | Moriyama | |
| 4,832,293 | A * | 5/1989 | Gizzi | 248/110 |
| 4,842,205 | A | 6/1989 | Araki | |
| 4,893,759 | A | 1/1990 | Mizobata | |
| 4,957,243 | A | 9/1990 | Kanagaki | |
| 5,188,301 | A | 2/1993 | Hasegawa | |
| 6,065,696 | A | 5/2000 | Tsai | |
| 6,135,310 | A * | 10/2000 | Svehaug | 220/700 |
| 6,460,790 | B1 * | 10/2002 | Wu Huang | 241/100 |
| 6,550,701 | B1 | 4/2003 | Chang | |
| 7,025,293 | B2 * | 4/2006 | Matlin et al. | 241/100 |
| 2005/0072789 | A1 * | 4/2005 | Einav et al. | 220/756 |
| 2005/0072869 | A1 * | 4/2005 | Ting | 241/100 |
| 2006/0124789 | A1 * | 6/2006 | Matlin et al. | 241/100 |

FOREIGN PATENT DOCUMENTS

| | | | |
|---|---|---|---|
| DE | 2214800 | | 9/1973 |
| DE | 3633109 | | 3/1988 |
| DE | 3633109 | A1 | 3/1988 |
| DE | 10008442 | A1 | 8/2001 |
| EP | 0 281 136 | | 9/1988 |
| EP | 0 503 957 | | 9/1992 |
| EP | 0 505 109 | | 9/1992 |
| EP | 1127621 | A2 | 8/2001 |
| FR | 7637761 | | 7/1978 |
| FR | 77 06557 | | 10/1978 |
| GB | 2 171029 | A | 8/1986 |
| JP | 06312144 | | 11/1994 |

OTHER PUBLICATIONS

Panasonic KX-4100 Auto-Feed paper shredder photograph, Service Manual, and Supplement-1 to the Service Manual.
German language brochure of Schleicher & Co. AG.
Brochure for Intimus Datenex 2000 shredder.
Brochure for an IDEAL 2400 paper shredder.

* cited by examiner

*Primary Examiner*—Faye Francis
(74) *Attorney, Agent, or Firm*—Venable LLP; Roy A. Kim

(57) ABSTRACT

The present invention relates generally to shredder openings or throats. Specifically, this invention teaches a shredder housing with a top throat to allow material to be disposed of from above the shredder, as well as a side throat to allow for material to be disposed of from the side of the shredder. This is accomplished by placing a guiding member in the throat to assist both the top and side input. Additionally, the guiding member can serve as a handle to assist in lifting the housing from the base.

4 Claims, 4 Drawing Sheets

TOP AND SIDE LOADING SHREDDER WITH OPTIONAL HANDLE

BACKGROUND OF THE INVENTION

1. Field of the Invention

The present invention relates generally to the openings through which materials to be shredded are fed into shredders. Specifically, this invention discloses a shredder housing with at least two openings which allow paper, plastic, and other forms of media that hold information to be fed into a shredder from either the top of the shredder or from the side of the shredder. Additionally, the invention discloses a convenient handle for lifting up the shredder housing.

2. Background Information

With increased privacy concerns, shredders have become an integral part in both homes and businesses. Though originally used to destroy paper products, shredders are now used to shred other forms of media that hold information, such as compact discs. In addition, credit cards and other plastic products are commonly shredded.

Prior art shredders have an opening or throat on the top of the housing through which material to be shredded is inserted. If the shredder is situated in an open area with nothing obstructing the top of the shredder then this configuration is convenient.

However, a problem occurs if the shredder is placed underneath a desk or other piece of furniture. In this situation, the overhead obstruction may prevent insertion of materials to be shredded into the top throat. Accordingly, the present invention seeks to employ another side throat through which material to be shredded can be inserted.

One preferred embodiment of the claimed invention provides this by adding a guiding member to a wide throat which allows for both top and side input of material. Additionally, the guiding member can be used as a handle to assist in lifting the housing from the base, thus allowing the contents of the base to be discarded. Since the housing can be heavy due to the shredder mechanism inside, the guiding input/handle facilitates removal of the housing mechanism from the shredder base.

From the preceding descriptions, it is apparent that the devices currently being used have significant disadvantages and/or limitations. Thus, important aspects of the technology used in the field of invention remain amenable to useful refinement.

SUMMARY OF THE INVENTION

The present invention relates to an apparatus that satisfies the need for a shredder housing that allows for both top and side input of material to be shredded, as well as for a handle to readily assist in removal of the housing from the base.

In one preferred embodiment, a guiding member is placed in the throat of a shredder which allows for material to be inserted through both the top and side of the shredder housing. Material inserted through the top feeds straight down into the shredder mechanism. Material inserted through the side of the shredder housing is initially inserted into the housing parallel to the ground. The material then slides along the side wall of the guiding member and curves downward until it is substantially perpendicular to the ground where it then enters the shredding mechanism. In addition to guiding the material into the shredder, the guiding member can also be lifted up and serve as a handle to assist in lifting the housing from the base.

All of the foregoing operational principles and advantages of the present invention will be more fully appreciated upon consideration of the following detailed description with reference to the drawings.

BRIEF DESCRIPTION OF THE DRAWINGS

The features and advantages of this invention are better understood with regard to the following drawings, description, and claims. The drawings consist of the following:

DETAILED DESCRIPTION OF THE INVENTION

Figure 1:
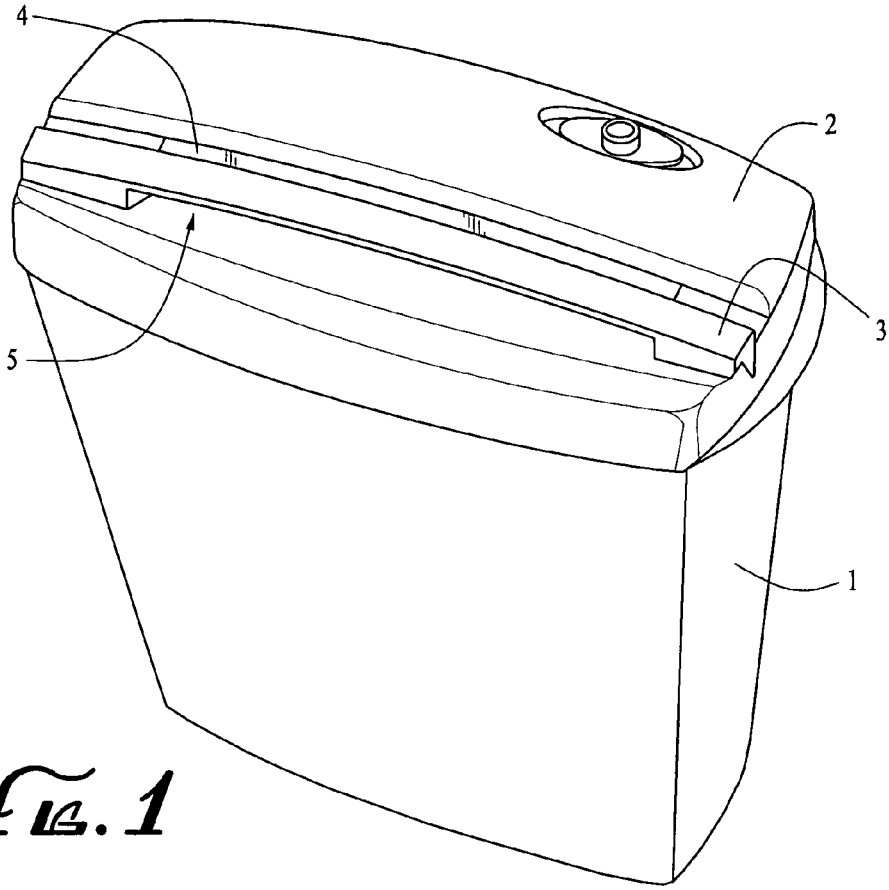
FIG. 1 is a perspective view of a shredder embodying features of this invention.
Figure 2:
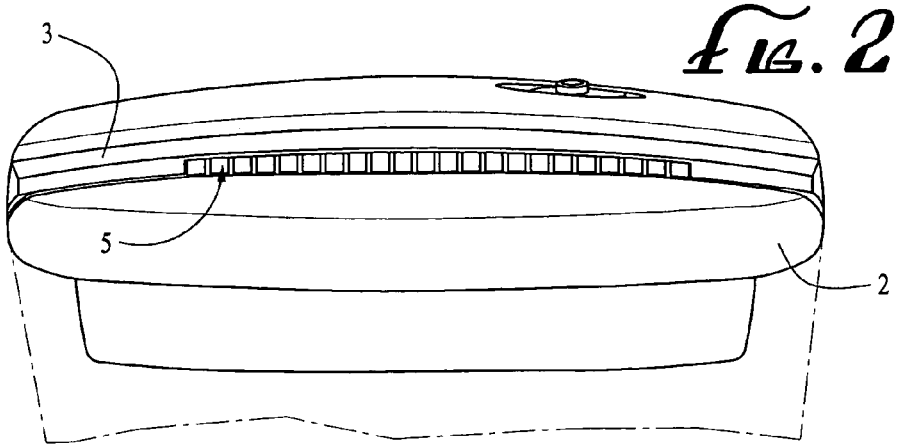
FIG. 2 is a side view of a shredder housing embodying features of this invention.
Figure 3:
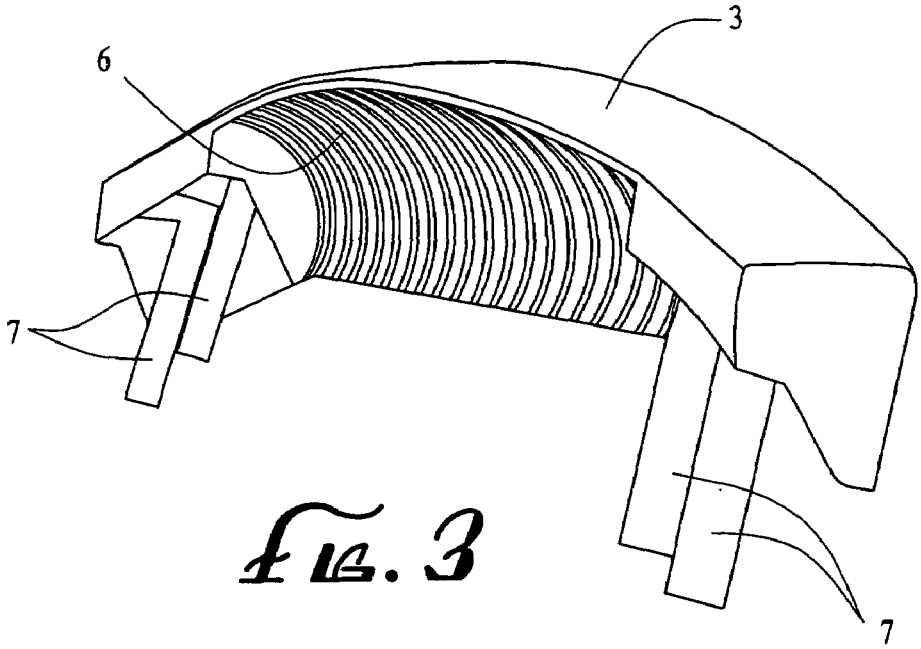
FIG. 3 is an exploded perspective view of the guiding member embodying features of this invention.
Figure 4:
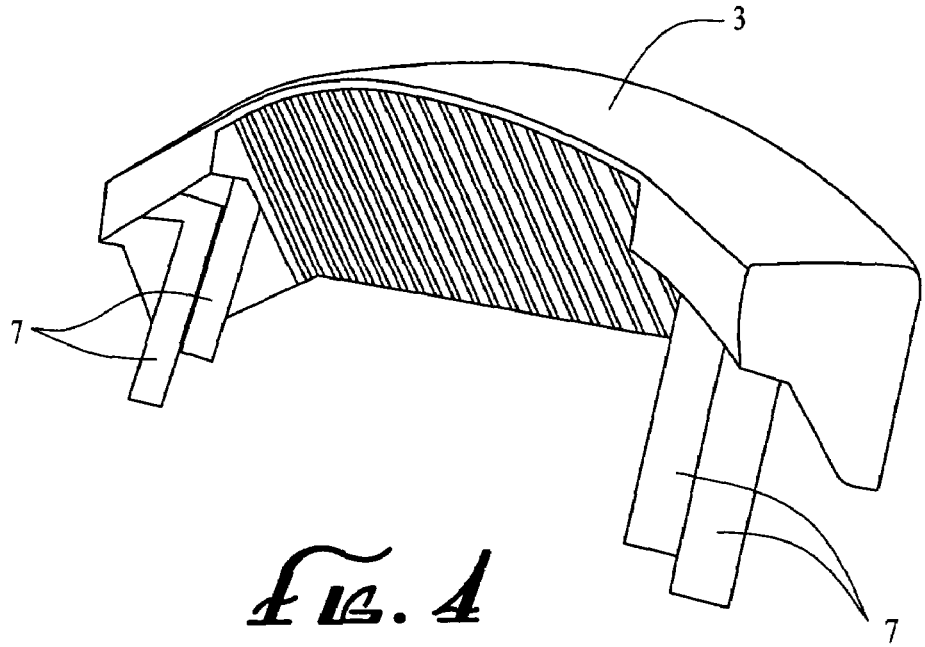
FIG. 4 is an exploded perspective view of another guiding member embodying features of this invention.
Figure 5:
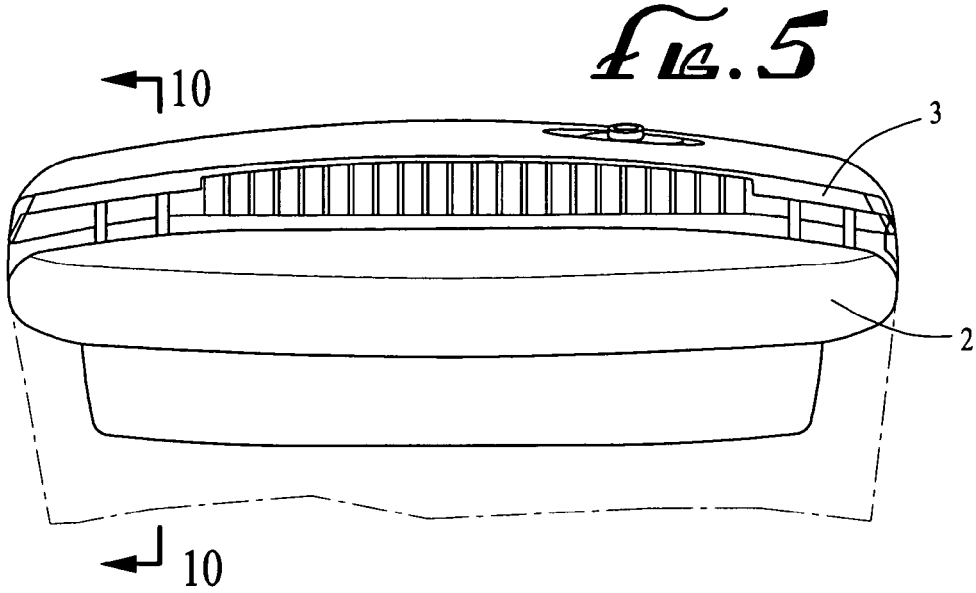
FIG. 5 is a side view of a shredder housing embodying features of this invention.
Figure 6:
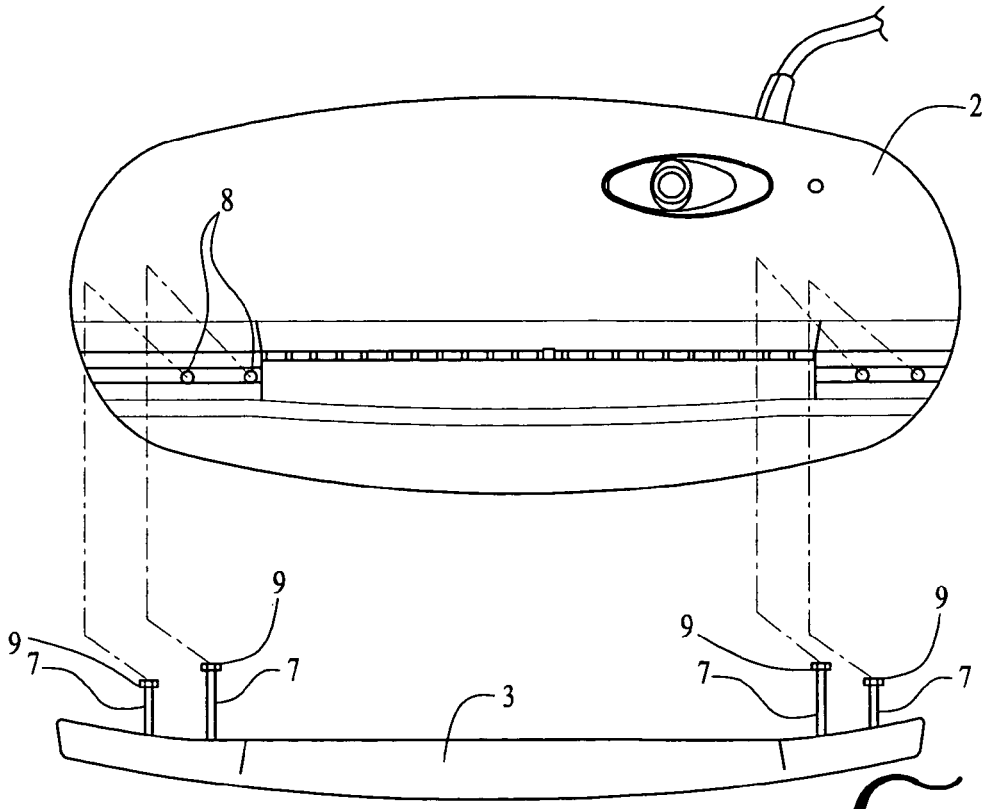
FIG. 6 is a top plan view of a shredder housing embodying features of this invention and a side view of the guiding member embodying features of this invention.
Figure 7:
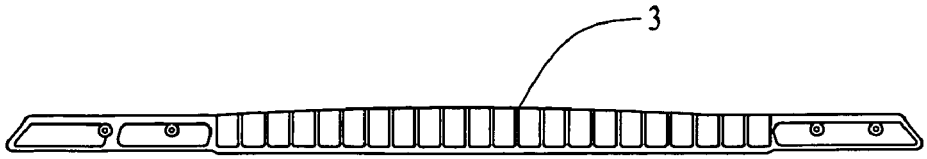
FIG. 7 is a bottom plan view of the guiding member embodying features of this invention.
Figure 8:
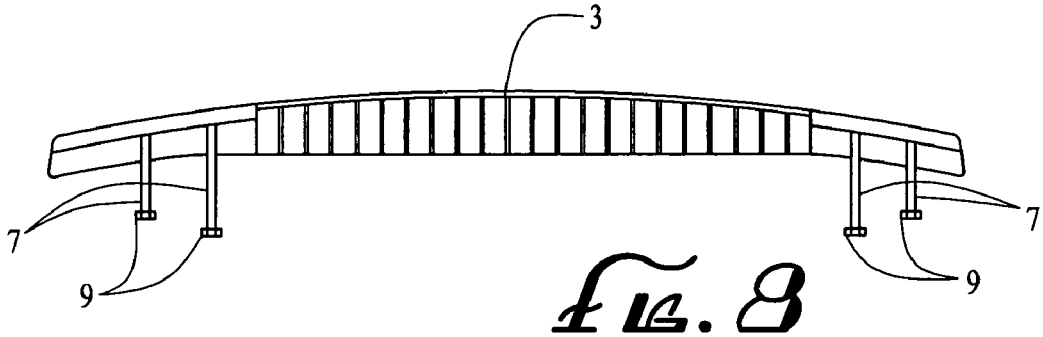
FIG. 8 is a side view of the guiding member embodying features of this invention.
Figure 9:
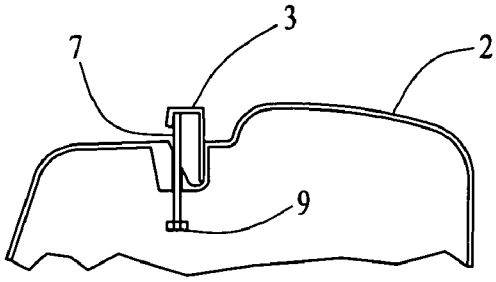
FIG. 9 is a cross sectional view of the side of a housing embodying features of this invention.
Figure 10:
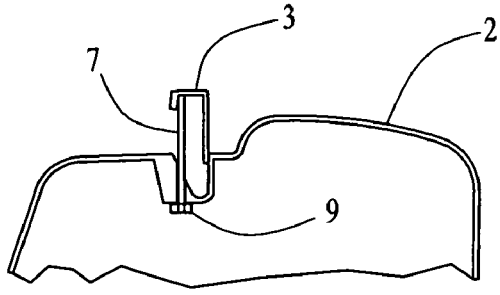
FIG. 10 is a cross sectional view of the side of a housing embodying features of this invention.

The essential elements of a shredder are comprised of a base 1, a housing 2, and a shredder mechanism which resides in the housing. The shredder mechanism can be of any sort commonly known to those skilled in the art and is thus not described herein.

The housing 2 has an opening or throat that leads to the shredding mechanism. Material to be shredded is then fed through the throat and into the shredding mechanism.

This invention discloses a guiding member 3 which allows material to be inserted into either the top throat 4 or side throat 5 of the shredder. As detailed below, the guiding member 3 may also serve as a handle to assist in lifting and carrying the housing 2 from the base 1.

FIGS. 1-10 disclose a preferred embodiment of a shredder housing 2 with top and side throats. As shown in FIG. 1, material to be shredded can be inserted from above the shredder into the top throat 4. Material fed from above goes directly through the top throat 4 and into the shredder mechanism.

If the shredder is in a location which does not allow for material to be inserted from the top (such as under a desk), then the side throat 5 can be used. See FIG. 2. In this situation, when material is inserted into the side throat 5, the guiding member 3 facilitates the feeding of material into the shredding mechanism.

The guiding member 3 has a curved side wall 6 bordering the upper portion of the side throat 5 which facilitates the insertion of flexible materials to be shredded into the shredder mechanism. See FIG. 3. Material inserted through the side throat 5 of the shredder housing 2 which when initially fed is parallel to the ground, slides along the curved side wall 6 of the guiding member. The curved side wall 6 curves the flexible material downward until it is substantially perpendicular to the ground where it then enters the shredder mechanism.

The opposite side of the curved side wall 6 which borders one side of the top throat is substantially straight and facilitates material insertion of material into the top throat 4.

It should be appreciated that although this preferred embodiment discloses a curved side wall 6 for feeding flexible materials into the shredder, inflexible materials can also be fed into the shredder mechanism via a wall that is not curved, but straight and angled directly into the shredding mechanism. See FIG. 4.

The guiding member 3 may also serve as a handle to assist in lifting the shredder housing 2. As seen in FIGS. 5-10, the guiding member 3 can be lifted upwards from the shredder housing 2 thus allowing the user to more readily grab a hold of the guiding member/handle.

The guiding member 3 has at least one post 7 towards each end which secure and align the guiding member 3 into mating apertures 8 in the housing. At the end of the posts 7 are appendages 9 which couple with the housing 2 when the guiding member is lifted vertically. See FIG. 10. When the guiding member 3 is in this position, it serves as a handle to assist in lifting the housing 2 when the contents of the base 1 need to be disposed of.

Although the present invention has been described in detail with respect to certain preferred versions thereof, other versions are possible. Therefore, the scope of the claims should not be limited to the description of the preferred versions contained herein.

The invention claimed is:

1. A shredder comprised of:

(a) a base;

(b) a housing on top of said base;

(c) a shredder mechanism which resides in said housing;

(d) a top throat in said housing which receives material to be inserted into said shredder mechanism at an angle substantially perpendicular to the ground;

(e) a side throat in said housing which receives material to be inserted into said shredder mechanism at an angle substantially parallel to the ground;

(f) a guiding member which separates said top throat and said side throat and facilitates the insertion of flexible materials to be shredded wherein said guiding member can be pulled upward to serve as a handle to assist in carrying said shredder housing.

2. The shredder of claim 1 wherein said guiding member has a curved side wall which borders the upper portion of said side throat and facilitates the insertion of flexible material to be shredded into the shredder mechanism.

3. The shredder of claim 1 or 2 wherein said guiding member has at least two posts towards each end which secure and align said guiding member into mating apertures in said housing.

4. The shredder of claim 2 wherein said posts have appendages which couple with said housing when said guiding member is lifted vertically.

* * * * *